US008176927B2

(12) United States Patent
Wu

(10) Patent No.: US 8,176,927 B2
(45) Date of Patent: May 15, 2012

(54) WALKING STICK WITH ALL-ROUNDED SUPPORT

(76) Inventor: King-Chang Wu, Taichung County (TW)

( * ) Notice: Subject to any disclaimer, the term of this patent is extended or adjusted under 35 U.S.C. 154(b) by 107 days.

(21) Appl. No.: 12/719,864

(22) Filed: Mar. 9, 2010

(65) Prior Publication Data

US 2011/0094552 A1 Apr. 28, 2011

(30) Foreign Application Priority Data

Oct. 27, 2009 (CN) ..... 2009 2 0220181 U

(51) Int. Cl.
*A61H 3/02* (2006.01)

(52) U.S. Cl. ..... 135/84; 135/65; 135/86; 248/188.9; 403/122

(58) Field of Classification Search ..... 135/65–66, 135/67, 70, 77, 81, 82, 84, 86; 248/188.1–188.3, 248/188.7–188.9, 481–482, 181.1–181.2; 403/122, 132, 166
See application file for complete search history.

(56) References Cited

U.S. PATENT DOCUMENTS 679,468 A * 7/1901 Pratt ..... 135/84
765,984 A * 7/1904 Morris et al. ..... 135/84
1,348,531 A * 8/1920 Amadio ..... 135/82
2,453,742 A 11/1948 Bowen
2,770,831 A * 11/1956 Angelica et al. ..... 16/24
3,622,112 A * 11/1971 Stroh ..... 248/181.1
4,440,186 A * 4/1984 Lottner ..... 135/84
4,510,957 A * 4/1985 Frank ..... 135/84
4,947,882 A * 8/1990 Levasseur ..... 135/84
5,390,687 A * 2/1995 Tsai ..... 135/65
5,794,638 A * 8/1998 Richey et al. ..... 135/65
7,047,990 B2 * 5/2006 Zambrano et al. ..... 135/82
7,841,799 B2 * 11/2010 Spratte et al. ..... 403/122

FOREIGN PATENT DOCUMENTS

DE 3102868 A1 * 8/1982

* cited by examiner

*Primary Examiner* — Winnie Yip

(57) ABSTRACT

This invention discloses a walking stick including a main body, a pivot connector and a socket. The main body is of the shape of stick and connects to the socket through the pivot connector. A sphere is inside the pivot connector. A sliding-proof elastic element locates between the bottom of the main body and the sphere. The sliding-proof elastic element and the sphere are mounted inside the pivot connector. A bottom of the sphere reaches the socket through the pivot connector. The sphere rotates inside the pivot connector as the socket moves, while being urged against the sliding-proof elastic element. The sliding-proof elastic element has characteristics of sliding proof, elasticity and wear resistance. Thereby the walking stick of the invention offers all-round support for the user in use. Especially the sliding proof effect of the sliding-proof elastic element restrains the instant movement of the sphere, and its elasticity offers an effect of shock resistance.

7 Claims, 8 Drawing Sheets

WALKING STICK WITH ALL-ROUNDED SUPPORT

BACKGROUND OF THE INVENTION

1. Field of the Invention

The present invention relates to a walking stick, and more specifically, to a walking stick which offers stable support and shock resistance by restraining the instant movement of a sphere with the cooperation of a sliding-proof elastic element and a pivot connector.

2. Related Prior Art

A conventional walking stick assists a user who needs help to keep stable in walking. However, a single-mode walking stick cannot work well at all conditions of roads the user walks.

Referring to FIG. 1, a conventional walking stick 1 has a base 2 at its bottom for touching the ground. Since the base 2 is fixed to the main body of the walking stick 1 and cannot be bent or rotatable to a certain degree, the walking stick 1 can support the user on the flat road. However, it cannot work out on slant surfaces as shown in FIG. 2 because the walking stick itself is in a slant state as well and therefore fails to keep the user balanced. In the case of bumpy surfaces, the walking stick 1 may stand unstably, which easily makes the user fall down due to unbalance.

Some approaches have been attempted to solve the above problems. For example, a movable socket is added to the bottom of the walking stick where there is mounted a ball. The ball seats in a round groove of the socket so that it is allowed to rotate to a certain degree for application of various road conditions. However, the ball usually rotates too fast to hold the user in a balanced way when the socket tilts according to the road conditions, causing the user to easily fall down.

U.S. Pat. No. 1,348,531 recites a walking stick which has a spherical space at its bottom for the movement of two semi-spheres. A spring is located between the two semi-spheres. A leg extends downward from the above one of the two semi-spheres to slightly move according to the socket. The spring is not used for shock resistance but extend space between the two semi-spheres for movement instead, so that the two semi-spheres are limited to rotate. Even though the semi-spheres are limited in rotation, their high sensitivity in response to the orienting change of the spherical space relative to the semi-spheres brings instability to the user in use.

U.S. Pat. No. 2,453,742 discloses a walking stick having a ball at its bottom with a spring urging against the ball the bottom. The ball is received in a leg, using a spiral stud to urge against the ball so as to control the friction to the ball and thus the rotation of the ball. However, the spiral stud detaches from the ball sometimes, especially when the leg hits the ground, causing the ball freely rotates so that the walking stick fails to function to keep the user walking stably.

The present invention is therefore intended to obviate or at least alleviate the problems encountered in prior art.

SUMMARY OF THE INVENTION

It is an objective of the present invention to provide a walking stick with all-rounded support. The walking stick has a movable socket, a sliding-proof elastic element, a sphere and a pivot connector in a manner to keep the user to walk stably at various road conditions. The sliding-proof elastic element is used to restrain the instant movement of the sphere and also provide an effect of shock resistance.

It is another objective of the present invention to provide a walking stick with all-rounded support. The walking stick has a movable socket, a magnetic sliding-proof elastic element, a magnetic sphere and a pivot connector. By the magnetic attraction of the sliding-proof elastic element and the magnetic sphere, the instant movement of the ball is further restrained so that the user can be kept more stably.

In order to achieve the above and other objectives, the walking stick of the invention includes a main body, a pivot connector and a socket. The main body is of the shape of stick and connects to the socket through the pivot connector. A sphere is inside the pivot connector. A sliding-proof elastic element locates between the bottom of the main body and the sphere. The sliding-proof elastic element and the sphere are mounted inside the pivot connector. A bottom of the sphere reaches the socket through the pivot connector. The sphere rotates inside the pivot connector as the socket moves, while being urged against the sliding-proof elastic element. The sliding-proof elastic element has characteristics of sliding proof, elasticity and wear resistance. Thereby the walking stick of the invention offers all-rounded support for the user in use. Especially the sliding proof effect of the sliding-proof elastic element restrains the instant movement of the sphere, and its elasticity offers an effect of shock resistance.

Other objectives, advantages and features of the present invention will become apparent from the following description referring to the attached drawings.

BRIEF DESCRIPTION OF THE DRAWINGS

The present invention will be described via detailed illustration of the preferred embodiment versus prior art referring to the drawings where.

DETAILED DESCRIPTION OF THE INVENTION

Figure 1:
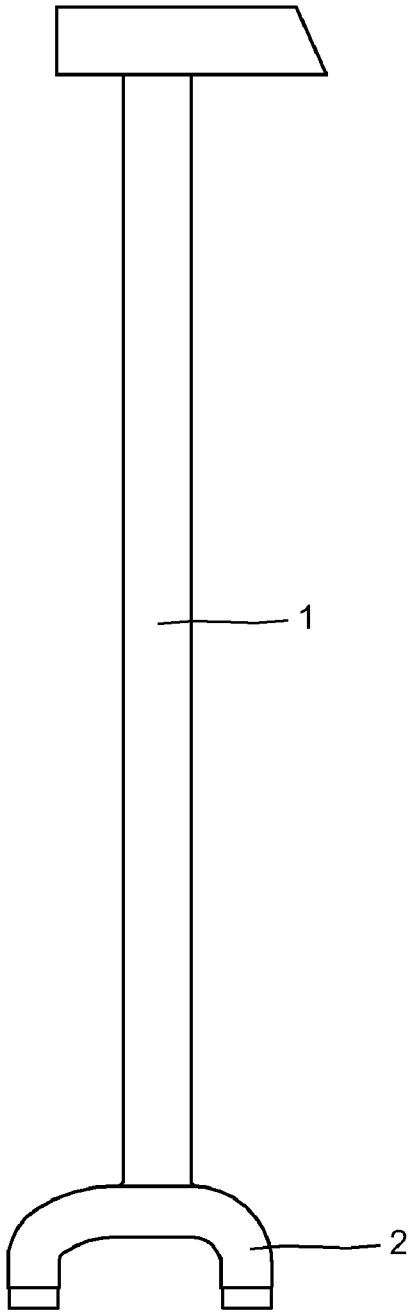
FIG.1 Prior Art
FIG. 1 is a schematic view of a conventional walking stick.
Figure 2:
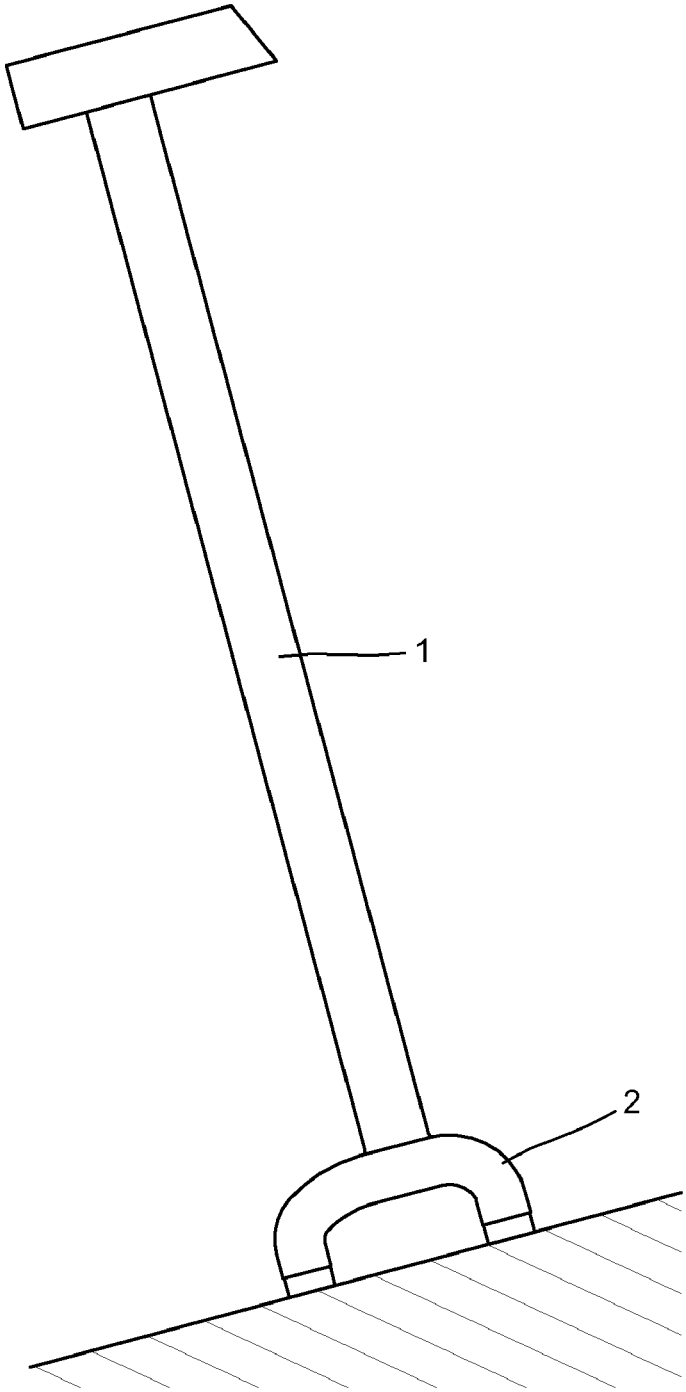
FIG.2 Prior Art
FIG. 2 is a schematic view showing the application of a conventional walking stick on a slant ground.
Figure 3:
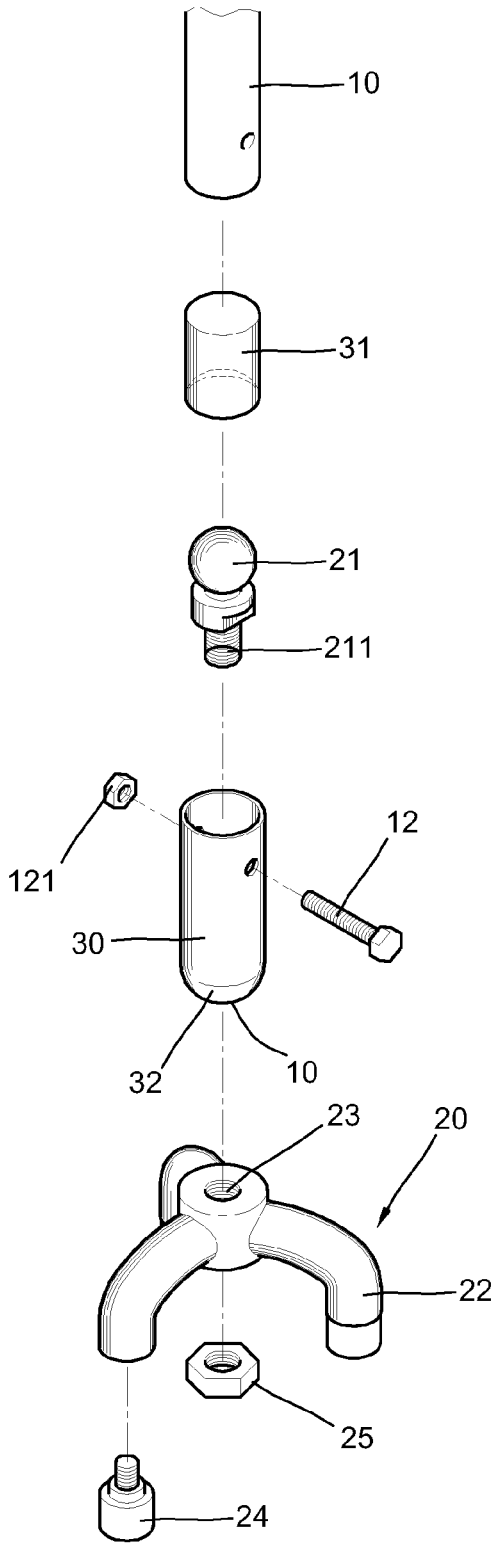
FIG. 3 is schematically exploded view of a walking stick according to a first embodiment of the invention.
Figure 4:
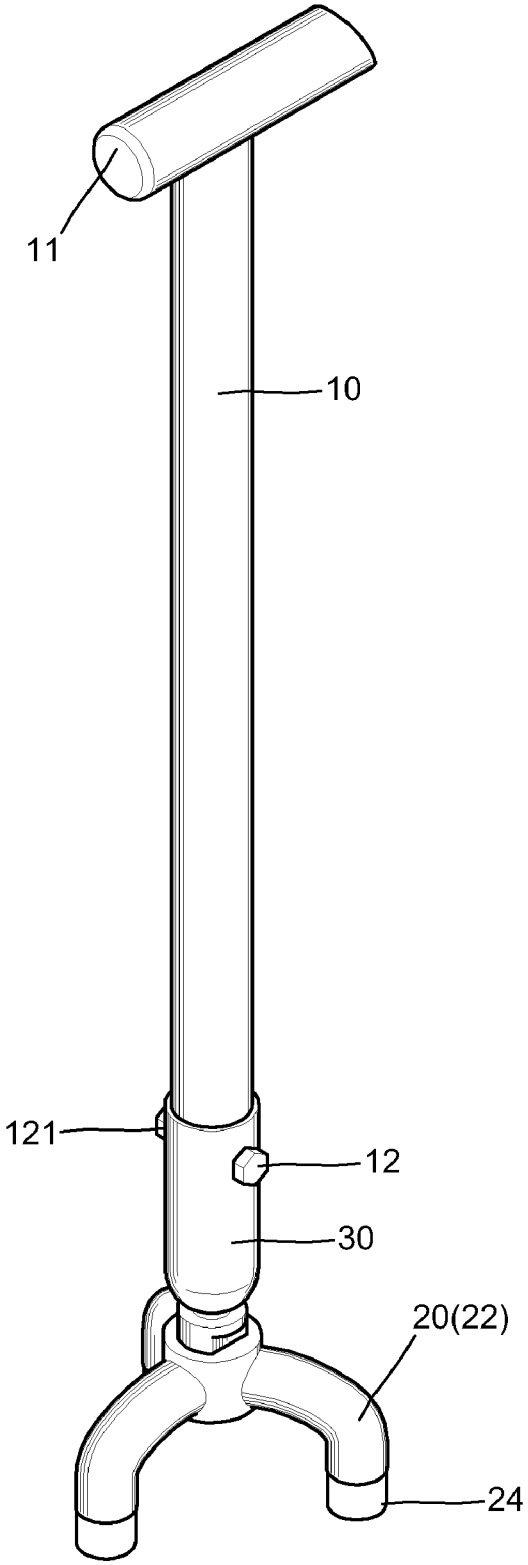
FIG. 4 is a schematic view of a walking stick in assembly according to a first embodiment of the invention.
Figure 5:
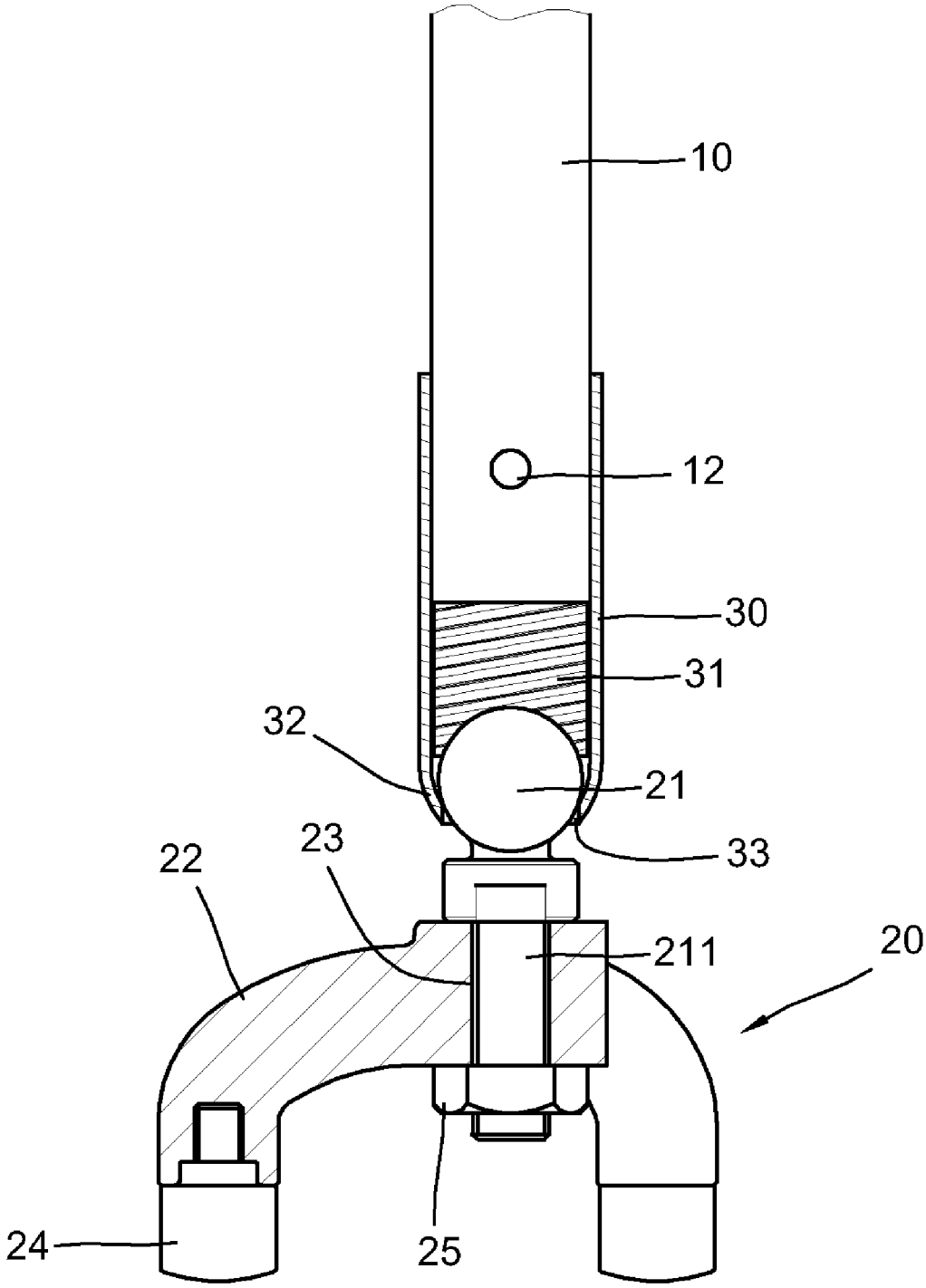
FIG. 5 is a schematic cross-sectional view of a part of a walking stick according to a first embodiment of the invention.

This invention provides a walking stick with all-rounded support. As shown in FIG. 3 through FIG. 6, which collectively show a first embodiment of the invention, the walking stick includes a main body 10, a socket 20 and a pivot connector 30. The main body 10 is of the shape of stick and has a handle 11 at its top for the user to hold. A bottom of the main body 10 connects to the socket 20 through the pivot connector 30. The pivot connector 30 is of the shape of sleeve, and has a bottom 32 with an opening 33 of a tapering diameter. The main body 10 is received in the top of the pivot connector 30. A threaded cylindrical rod 12 and a cap 121 with corresponding threaded hole to engage with the threaded cylindrical rod 12 are used to fasten the main body 10 to the pivot connector 30. The threaded cylindrical rod 12 penetrates through the pivot connector 30 to reach one end of the main body 10.

Inside the pivot connector 30 are mounted a sliding-proof elastic element 31 and a sphere 21.

The sliding-proof elastic element 31 is made of plastics which benefits the outstanding elasticity, sliding proof and wear resistance. The sliding-proof elastic element 31 locates between the bottom of the main body 10 and the sphere 21, and has an arced recess at its bottom so that the sphere 21 can be accommodated in the pivot connector 30. The diameter of the opening at the bottom 32 of the pivot connector 30 is smaller than an outer diameter of the sphere 21 so that the sphere 21 is kept inside the pivot connector 30 and being rotatable around the bottom 32 of the pivot connector 30. The sphere 21 is urged against the sliding-proof elastic element 31. A spiral stud 211 is positioned beneath the sphere 21 in a manner to penetrate through the opening 33 of the pivot connector 30 until reach the socket 20 so that the sphere 21 moves instantly with the socket 20. The socket 20 has three legs 22 and has a central threaded hole 23 for engaging with the spiral stud 211 of the sphere 21. Each leg 22 screws to an elastic pad 24 at its bottom.

Figure 6:
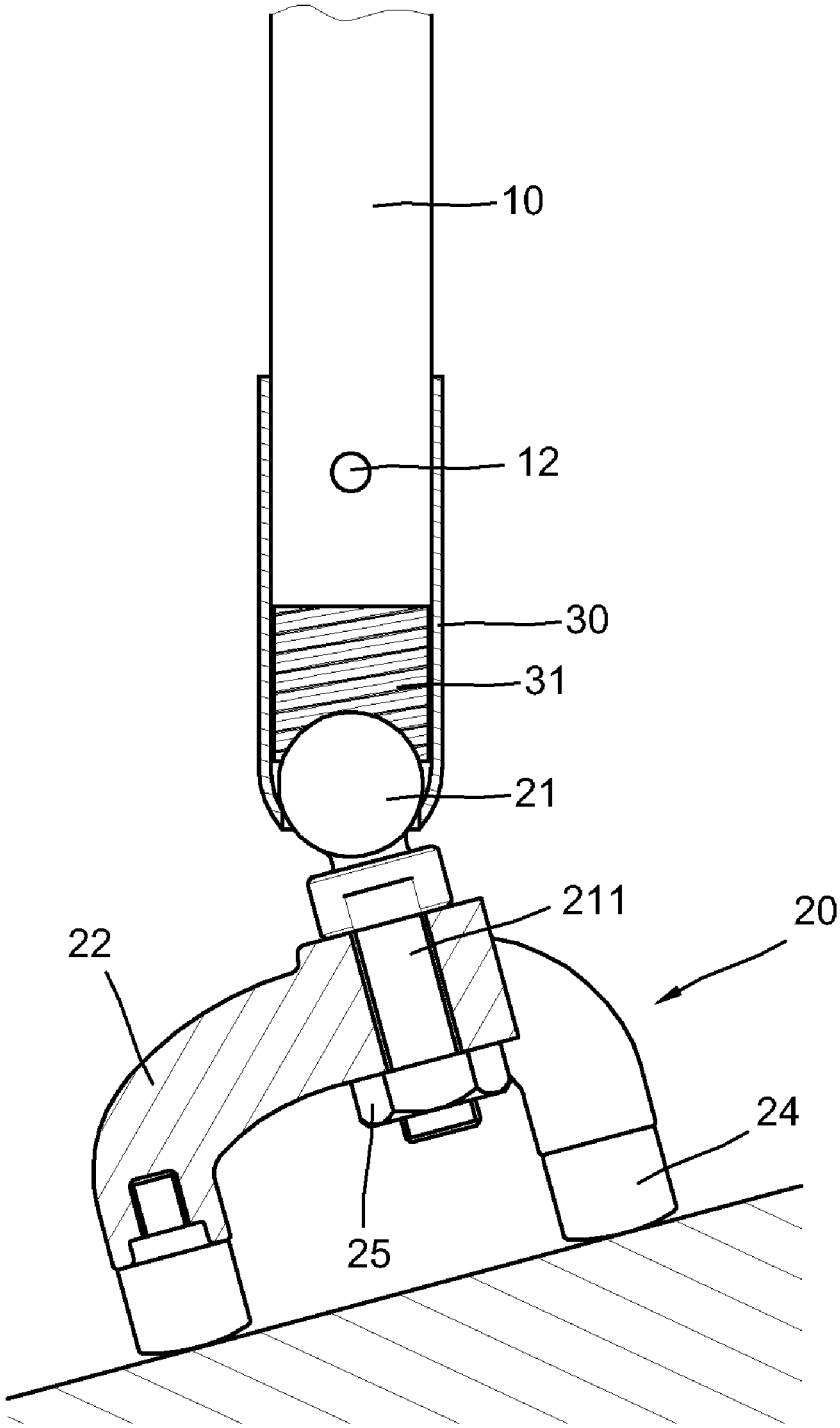
FIG. 6 is a schematic cross-sectional view of a walking stick applied to a slant ground according to a first embodiment of the invention.

In the walking stick with all-rounded support according to the invention, as illustrated in the first embodiment, when the user holds the handle 11 at the top of the main body 10 and have the legs 22 and the elastic pad 24 to contact the tilted and bumpy ground, the legs 22 and the elastic pad 24 come to tilt relative to the pivot connector 30 and the main body 10 so that the sphere 21 inside the pivot connector 30 is driven to pivot. In response to the applied force by the user, the main body 10 provides the all-rounded support. Furthermore, the instant movement, i.e. rotating speed of the sphere 21, of the sphere 21 inside the pivot connector 30 is restrained by the sliding-proof elastic element 31 pressing on the sphere 21. Thereby, the main body 10 can be kept vertical to help the user stably walk. Even though in a highly slant circumstance as shown in FIG. 6, the main body 10 can be also kept vertical and therefore the user can be safe during walking.

The sliding-proof elastic element 31 further offers elasticity, in addition to help restrain the instant movement of the sphere 21. When the user holds the walking stick while walking on a flat, bumpy or slant roads, the legs 22 in contact with the roads generate a counterforce delivering to the user through the main body 10. The sliding-proof elastic element 31 advantageously absorbs the shock caused by the counterforce, providing an effect of shock resistance and protecting the hands of the user from being hurting after often use.

Figure 7:
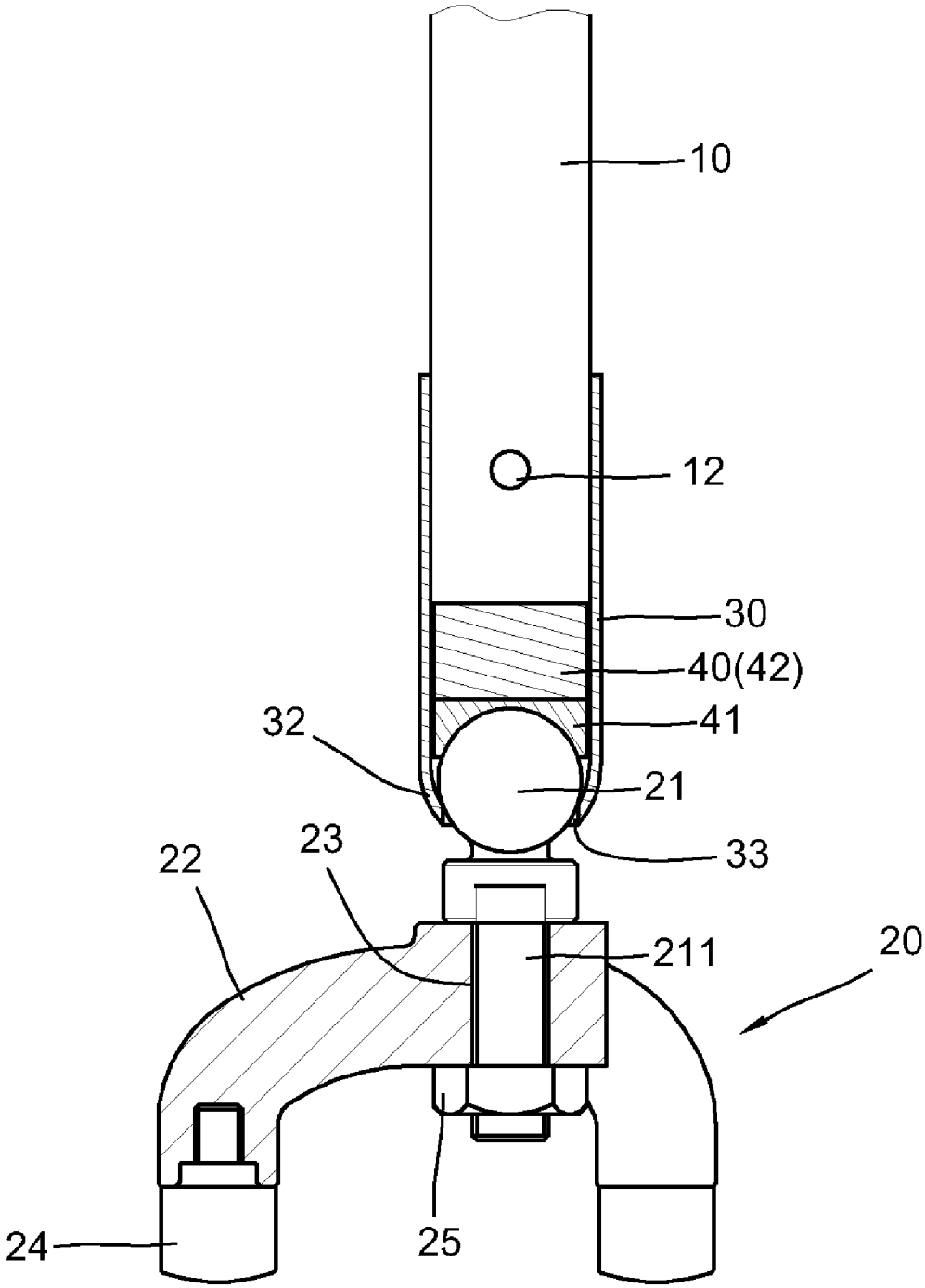
FIG. 7 is a schematic cross-sectional view of a walking stick according to a second embodiment of the invention.
Figure 8:
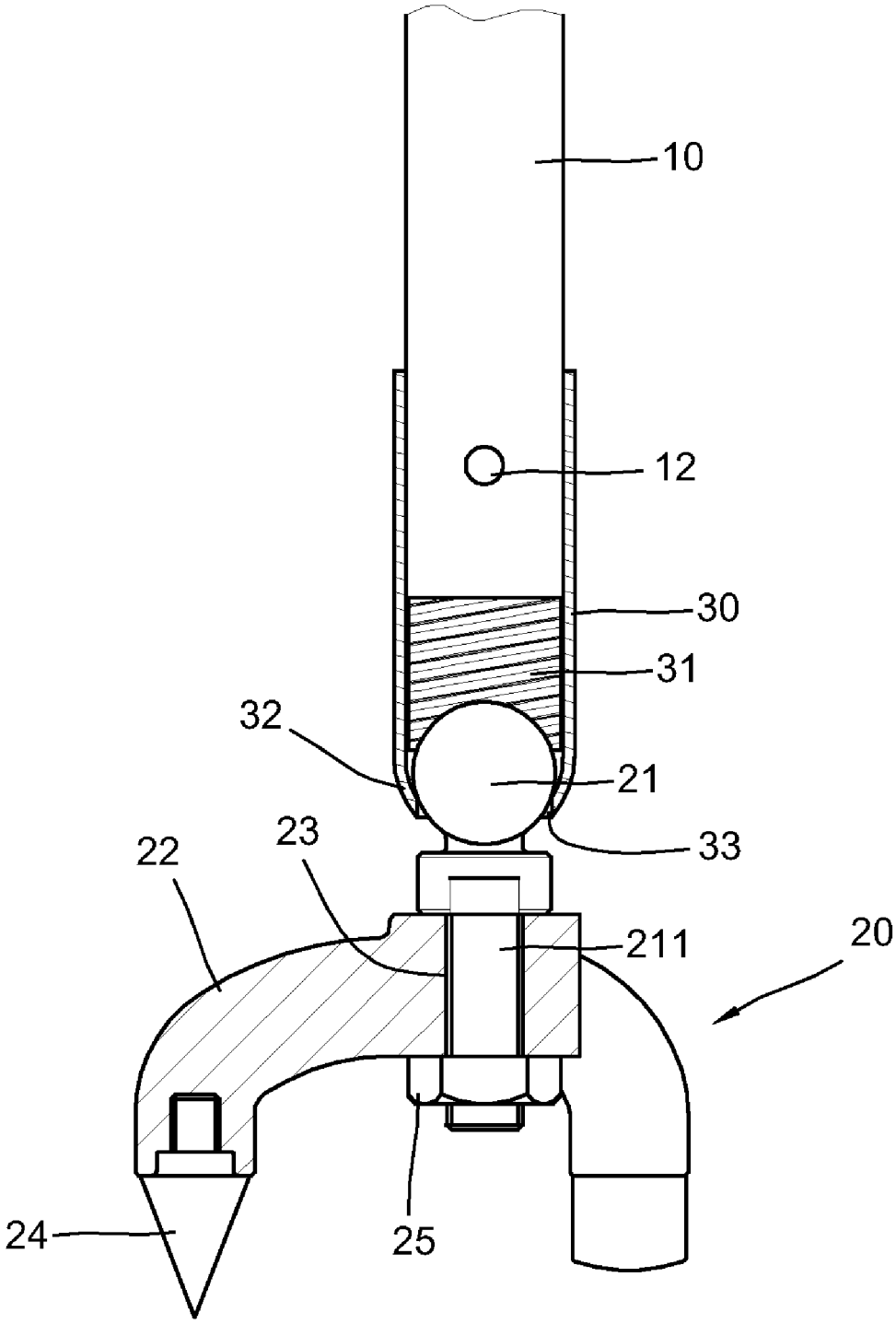
FIG. 8 is a schematic cross-sectional view of a walking stick according to a third embodiment of the invention.

FIG. 7 illustrates a second embodiment of the invention. As shown, a sliding-proof elastic element 40 has an elastic washer 41 and a magnet 42. The elastic washer 41 has an arced recess at its bottom in contact with the sphere 21 made of magnetically conductive material. The magnet 42 locates above the elastic washer 41. The elasticity, sliding proof and wear resistance of the elastic washer 41 contribute to restrain the instant rotation of the sphere 21 while the sphere 21 is magnetically attracted by the magnet 42. The use of the elastic washer 41 and the magnet 42 adds more safety in use to the main body 10.

The present invention has been described via the detailed illustration of the preferred embodiment. Those skilled in the art can derive variations from the preferred embodiment without departing from the scope of the present invention. Therefore, the preferred embodiment shall not limit the scope of the present invention defined in the claims.

What is claimed is:

1. A walking stick, comprising a main body, a socket and a pivot connector, the main body being of an elongated stick and connecting to the socket through the pivot connector, and a sphere being inside the pivot connector, wherein a sliding-proof elastic element locates between a bottom of the main body and the sphere; the sliding-proof elastic element is an elastic washer and a magnet, the elastic washer has an arced recess at its bottom in contact with the sphere, and the magnet locates above the elastic washer; the sliding-proof elastic element and the sphere are mounted inside the pivot connector; the socket has a plurality of legs and a central threaded hole, a bottom of the sphere has a spiral stud extending through the pivot connector to engage with the central threaded hole; the sphere rotates inside the pivot connector as the socket moves, while being kept urged against the sliding-proof elastic element.

2. The walking stick of claim 1, wherein the socket has three legs.

3. The walking stick of claim 2, wherein each of the legs screws to an elastic pad.

4. The walking pad of claim 1, wherein the sliding-proof elastic element is made of elastic plastics.

5. The walking pad of claim 1, wherein the pivot connector is of the shape of sleeve and has a bottom with an opening of a tapering diameter smaller than an outer diameter of the sphere.

6. The walking pad of claim 1, wherein the main body locates inside a top of the pivot connector, with a threaded cylindrical rod penetrating through the pivot connector and the main body.

7. The walking pad of claim 1, wherein the sphere is made of magnetically conductive material.

* * * * *